US007810609B2

(12) United States Patent
Sikes et al.

(10) Patent No.: US 7,810,609 B2
(45) Date of Patent: Oct. 12, 2010

(54) MUFFLER

(75) Inventors: Timothy Sikes, Grass Lake, MI (US); Udo Gaertner, West Bloomfield, MI (US)

(73) Assignees: Chrysler Group LLC, Auburn Hills, MI (US); Woco Industrietechnik GmbH, Bad Soden-Salmuenster (DE)

( * ) Notice: Subject to any disclaimer, the term of this patent is extended or adjusted under 35 U.S.C. 154(b) by 0 days.

(21) Appl. No.: 11/937,530

(22) Filed: Nov. 9, 2007

(65) Prior Publication Data

US 2009/0078499 A1 Mar. 26, 2009

Related U.S. Application Data

(60) Provisional application No. 60/975,342, filed on Sep. 26, 2007.

(51) Int. Cl.

| | |
|---|---|
| ***F01N 1/02*** | (2006.01) |
| ***F01N 1/10*** | (2006.01) |
| ***F01N 1/24*** | (2006.01) |
| ***F01N 13/16*** | (2006.01) |
| ***F01N 13/18*** | (2006.01) |

(52) U.S. Cl. ..... 181/250; 181/246; 181/252; 181/256; 181/282

(58) Field of Classification Search ..... 181/250, 181/252, 282, 246, 256

See application file for complete search history.

(56) References Cited

U.S. PATENT DOCUMENTS

| | | | | |
|---|---|---|---|---|
| 3,187,837 | A * | 6/1965 | Beeching | 181/246 |
| 4,045,057 | A * | 8/1977 | Halter | 285/49 |
| 4,239,091 | A * | 12/1980 | Negrao | 181/243 |
| 4,993,513 | A * | 2/1991 | Inoue et al. | 181/282 |
| 5,052,513 | A * | 10/1991 | Yoshikawa et al. | 181/246 |
| 5,321,214 | A * | 6/1994 | Uegane et al. | 181/211 |
| 5,468,923 | A * | 11/1995 | Kleyn | 181/282 |
| 5,799,395 | A * | 9/1998 | Nording et al. | 29/890.08 |
| 5,979,598 | A * | 11/1999 | Wolf et al. | 181/272 |
| 6,543,577 | B1 * | 4/2003 | Ferreira et al. | 181/282 |
| 6,855,293 | B1 * | 2/2005 | Zengerle et al. | 422/100 |
| 7,007,720 | B1 * | 3/2006 | Chase et al. | 138/110 |
| 2005/0167192 | A1 * | 8/2005 | Simon | 181/256 |
| 2007/0157598 | A1 * | 7/2007 | Atanas et al. | 60/272 |

FOREIGN PATENT DOCUMENTS

| | | |
|---|---|---|
| EP | 1 171 223 B1 | 5/2003 |
| EP | 1 030 962 B1 | 8/2003 |
| EP | 1 900 913 A1 | 3/2008 |
| EP | 1 900 914 A1 | 3/2008 |
| EP | 1 332 071 B1 | 9/2008 |
| FR | 1.159.824 | 2/1958 |
| GB | 1 309 141 | 3/1973 |
| GB | 2129490 | 5/1984 |

* cited by examiner

*Primary Examiner*—Jeffrey Donels
*Assistant Examiner*—Christina Russell
(74) *Attorney, Agent, or Firm*—Ralph E. Smith

(57) ABSTRACT

An absorption muffler includes a metallic exhaust pipe including a plurality of perforations, a polymeric housing carried by the exhaust pipe and enclosing the plurality of perforations, and including axially opposed ends. Thermal insulation is carried radially between the exhaust pipe and the polymeric housing and axially between the axially opposed ends inclusive thereof. Acoustic insulation is carried between the thermal insulation and the polymeric housing.

28 Claims, 5 Drawing Sheets

MUFFLER

CROSS REFERENCE TO RELATED APPLICATION

This application claims the benefit of U.S. Provisional Patent Application Ser. No. 60/975,342, filed Sep. 26, 2007.

FIELD OF THE INVENTION

The present invention relates generally to engine exhaust systems, and more particularly to mufflers that attenuate engine exhaust acoustics.

BACKGROUND OF THE INVENTION

Exhaust systems typically muffle noise produced by combustion processes within engines. At a minimum, a typical exhaust system usually includes an exhaust pipe to carry engine exhaust gases and sound away from the engine, and a muffler to attenuate the sound propagated through the exhaust pipe. Mufflers include two general types according to the mode by which noise is attenuated. Mufflers that attenuate noise by reflection of sound waves are called reactive or reflection mufflers. Mufflers that attenuate noise by absorption of sound waves are known as dissipative or absorption mufflers.

Reflection mufflers are particularly useful for low-frequency applications and for high-temperature applications that restrict or preclude use of absorption mufflers. Reflection may be provided by resonators or changes in exhaust flow direction by labyrinth-like baffling in the muffler. Reflection mufflers usually include a hollow steel housing defining an expansion chamber and one or more baffles and/or resonator chambers in communication with the expansion chamber, a steel inlet pipe extending into the expansion chamber, and a steel outlet pipe extending from the expansion chamber to the outside. Sound waves enter the main chamber through the inlet pipe, and reflect off various baffles or other surfaces in the chambers to cancel each other out and thereby reduce noise. Reflection mufflers may produce undesirable backpressure.

Current absorption mufflers may be used in applications where low pressure drop and high attenuation at predominantly middle and high frequencies are required. Absorption mufflers typically include a steel housing defining one chamber, a perforated pipe extending completely through the chamber of the housing, and absorption material disposed in the chamber between the pipe and the housing. Sound waves enter the chamber through the perforated pipe, and become absorbed by the absorption material. Until now, absorption mufflers generally produced less sound control than reflective mufflers.

SUMMARY OF THE INVENTION

An implementation of a presently preferred muffler includes an exhaust pipe having a plurality of perforations and at least one pipe sealing flange extending generally radially outwardly. The muffler also includes a housing carried by the exhaust pipe and enclosing the plurality of perforations and including at least one housing sealing flange extending generally radially inwardly and spaced radially from the exhaust pipe and spaced axially from the at least one pipe sealing flange carried by the exhaust pipe. The muffler further includes thermal insulation disposed axially between the at least one pipe sealing flange and the at least one housing sealing flange, and radially between the at least one housing sealing flange and the exhaust pipe, and radially between the at least one pipe sealing flange and the housing.

Another implementation of a presently preferred absorption muffler includes a metallic exhaust pipe including a plurality of perforations, and a polymeric housing carried by the exhaust pipe and enclosing the plurality of perforations, and including axially opposed ends. The muffler also includes thermal insulation carried radially between the exhaust pipe and the polymeric housing and axially between the axially opposed ends inclusive thereof. The muffler further includes acoustic insulation separate from the thermal insulation and carried between the thermal insulation and the polymeric housing.

An implementation of a presently preferred polymeric housing for a muffler carryable on an exhaust pipe includes an outer shell. A plurality of walls extends generally radially inwardly from the outer shell and is radially spaceable from an outer surface of the exhaust pipe. The housing also includes a sealing end including a generally radially inwardly extending sealing wall radially spaceable from the outer surface of the exhaust pipe and axially spaceable from at least one sealing flange of the exhaust pipe.

BRIEF DESCRIPTION OF THE DRAWINGS

The following detailed description of preferred embodiments and best mode will be set forth with reference to the accompanying drawings, in which.

DETAILED DESCRIPTION OF PREFERRED EMBODIMENTS

Figure 1:
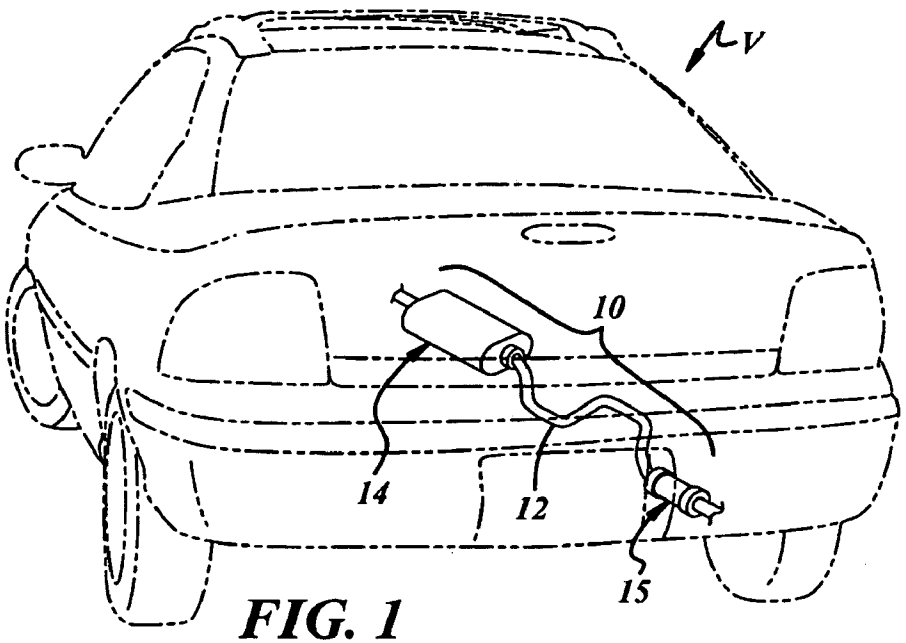
FIG. 1 is a schematic view of an embodiment of a vehicle including an exhaust system having upstream and downstream absorption mufflers to attenuate vehicle engine exhaust noise.

Referring in more detail to the drawings, FIG. 1 illustrates a schematic diagram of an exemplary vehicle V including an exhaust system 10, which is partially shown. The exhaust system 10 includes an exhaust pipe 12 and may include one or more mufflers including a first muffler 14 and/or a second muffler 15 downstream of the first muffler 14. The exhaust system 10 may be suspended or otherwise carried by the vehicle V in any suitable fashion. The mufflers 14, 15 may be used on other equipment besides motor vehicles.

Figure 2:
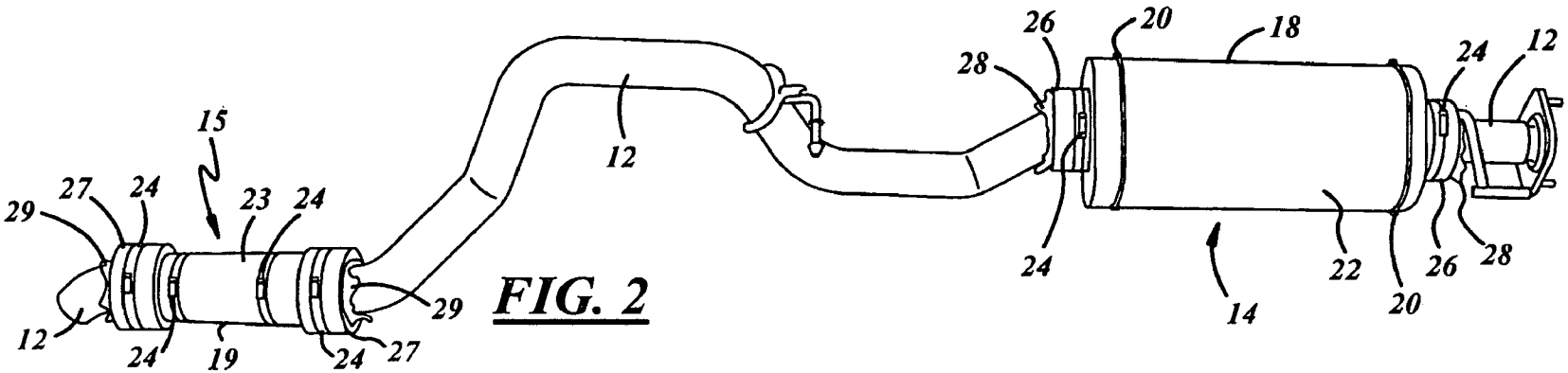
FIG. 2 is a partial top view of the exhaust system of FIG. 1.

Referring now to FIG. 2, the exhaust pipe 12 may be any type of conduit suitable for use in an exhaust system. For example, the exhaust pipe 12 may be metallic or at least partially composed of metal, for example, aluminized steel. The exhaust pipe 12 also may be a continuous component from an upstream side of the first muffler 14 to a downstream side of the second muffler 15 or may instead be constructed from a plurality of individual pipes in any suitable manner.

Still referring to FIG. 2, the mufflers 14, 15 are carried by the exhaust pipe 12 in any suitable fashion. The mufflers 14, 15 may include housings 18, 19 that may be constructed of multiple pieces. More specifically, the housings 18, 19 may be constructed from opposed clamshell halves or portions, although any number of pieces and type of construction may be used. For enhanced acoustic attenuation and corrosion resistance, the muffler housings 18, 19 may be composed of any suitable polymeric material, such as any suitable thermoplastic or thermoset. For example, the muffler housings 18, 19 may be composed of a high temperature polyamide material such as a glass filled NYLON and, more specifically, ZYTEL. HTN 51G35HSL, available from DuPont of Delaware.

The first muffler housing 18 may be generally oval and assembled from opposed semi-oval halves. The halves may be welded together along their common seam, may be integrally fastened together, and/or may be strapped together using any suitable straps such as zip ties 20 around a trunk 22 and/or band clamps 24 around one or more collars 26 that may be disposed at axially opposed sealing ends of the housing 18. The collars 26 are sown as being of reduced diameter compared to the trunk 22 but may be of any suitable size. The second muffler housing 19 may be generally cylindrical in shape and assembled from opposed semi-circular halves. The halves may be welded together along their common seam, may be integrally fastened together, and/or may be strapped together using any suitable straps such as band clamps 24 around a trunk 23 and/or one or more collars 27 at axially opposed sealing ends of the housing 19. The collars 27 are shown as being of increased diameter compared to the trunk 23 but may be of any suitable size. Finally, in FIG. 2, thermal insulation material can be seen protruding out of the sealing ends of the mufflers 18, 19 and the material may be from thermal insulation 28, 29, as described below with respect to FIG. 3.

Figure 3:
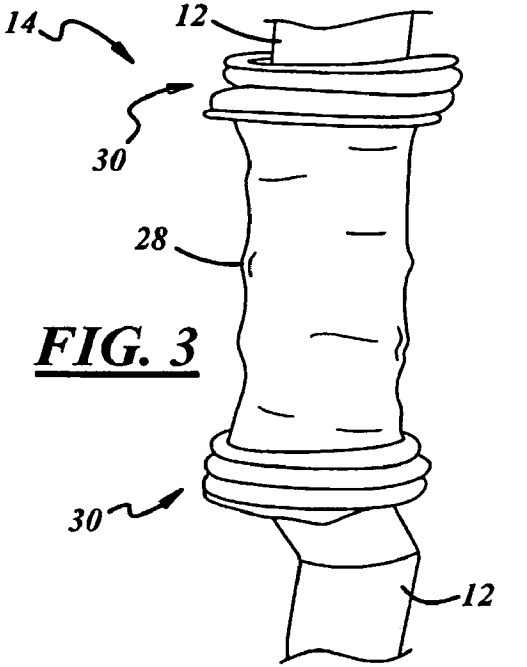
FIG. 3 is a partial top view of the upstream muffler of FIG. 1 with a housing and acoustic insulation removed to show thermal insulation covering a portion of an exhaust pipe.

As shown in exemplary FIG. 3, the first muffler 14 may include the thermal insulation 28 extending over a portion of the exhaust pipe 12. The thermal insulation 28 may include opposed sealing ends 30 that may cover corresponding underlying exhaust pipe sealing flanges (not shown) and other portions of the exhaust pipe 12 therebetween to cover the portion of the exhaust pipe 12 within the muffler housing 18. The thermal insulation 28 may be composed of any suitable thermal insulating material and may take any suitable form. For example, the thermal insulation may be composed of woven or non-woven glass fiber, such as ACOUSTA-FIL available from Culimeta-Saveguard Ltd. of Cheshire, UK that may include a continuous filament of electrical or E' glass fiber or silica or S' glass material. Any other type of thermal insulation suitable for use with exhaust systems and components also or instead may be used. Also, the thermal insulation may take the form of a sleeve or open-ended sock, and may be woven for compactness. Compared to the acoustic insulation, the thermal insulation may be a relatively thin but strong layer of material that may be pulled over, or wrapped around, the exhaust pipe 12.

Figure 4:
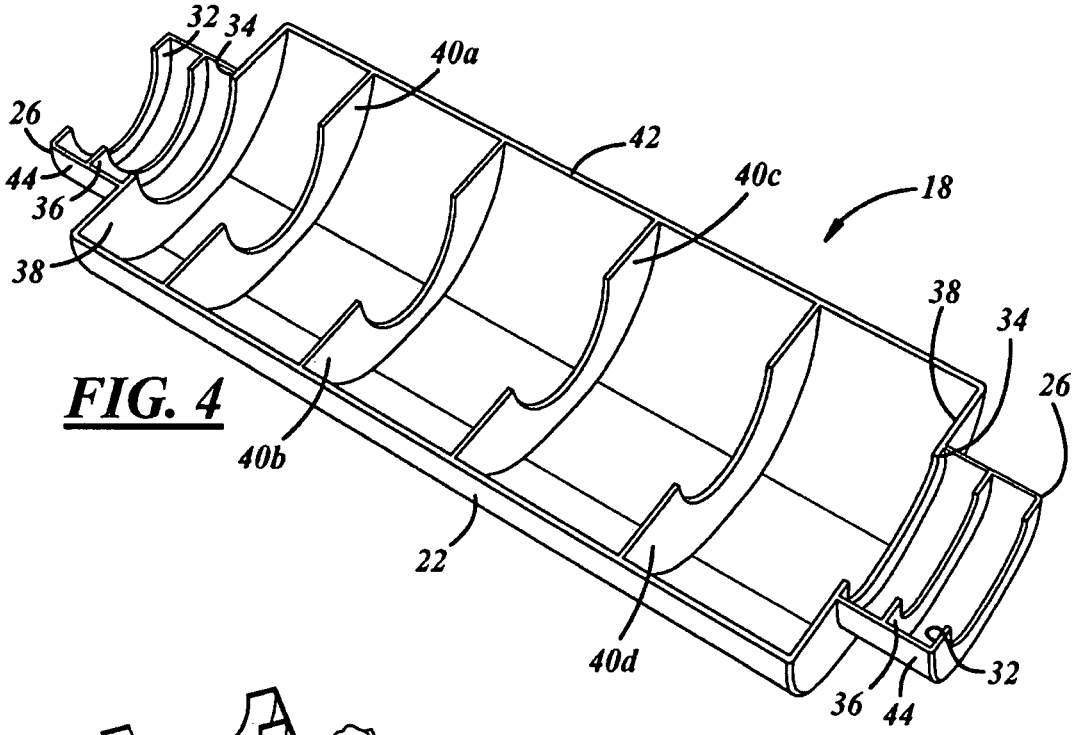
FIG. 4 is a perspective view of a portion of a housing of the upstream muffler of FIG. 1.

Referring now to FIG. 4, an empty portion of the first muffler housing 18 is shown with its interior exposed. The housing 18 may include the trunk 22 and the collars 26 at axially opposed ends of the housing 18. The collars 26 may include one or more generally radially extending sealing flanges, for example, axially outer end walls 32, axially inner end walls 34, and one or more divider walls 36 therebetween. Similarly, the trunk 22 may include axially outer end walls 38, and one or more divider walls 40*a*, 40*b*, 40*c*, 40*d* therebetween. The end walls 38 and divider walls 40*a*-40*d* extend inwardly from an outer shell 42 to at least partially define a plurality of acoustic chambers. As will be described in greater detail herein below with reference to FIG. 7, the walls 38, 40*a-d* may be evenly spaced apart and/or may be unevenly spaced in any suitable manner to provide equal or unequal sized acoustic chambers. Similarly, the walls 32, 34, 36 of the collars 26 extend from an outer shell 44 to at least partially define axial spaces or thermal chambers therebetween.

Figure 5:
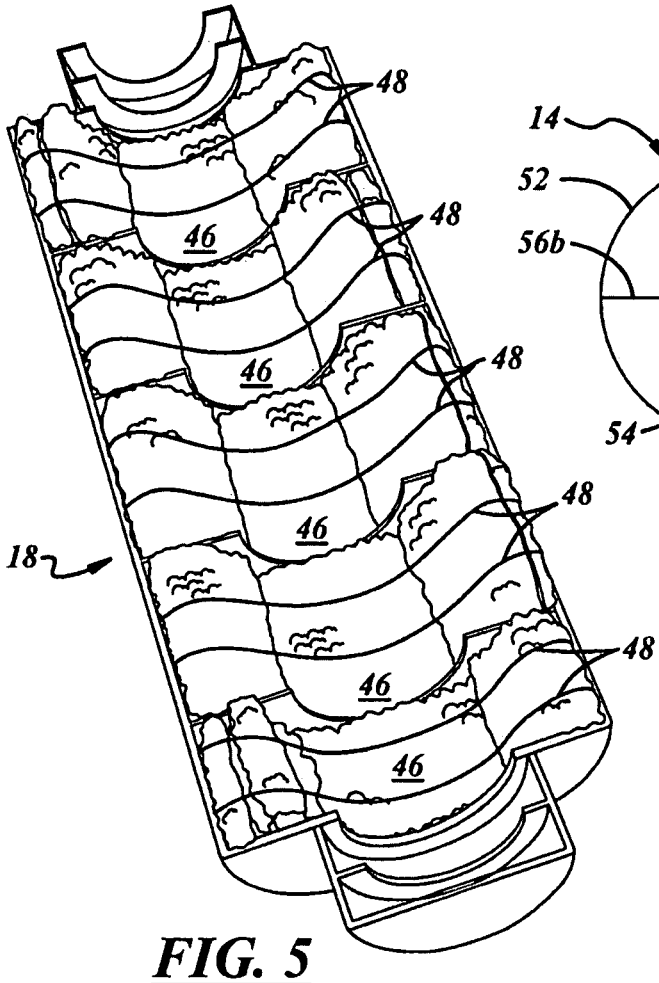
FIG. 5 is a perspective view of the housing portion of the upstream muffler shown in FIG. 4 and including acoustic insulation therein.

Referring to FIG. 5, the acoustic chambers may accept any suitable sound absorbing material or acoustic insulation 46 therein. The acoustic insulation 46 may be composed of any suitable material and may take any suitable form. For example, the acoustic insulation may be composed of woven or non-woven glass fiber, such as ACOUSTA-FIL CE available from Culimeta-Saveguard Ltd. of Cheshire, UK. Any other type of acoustic insulation suitable for use with exhaust systems and components also or instead may be used. More specifically, the acoustic insulation 46 may be a woven single thread fiber or continuous filament roving to reduce or eliminate blow-out of insulation fibers from the muffler housing 18, and may be a knit product for looseness. Also, the acoustic insulation 46 may be batting, wrap, or tape, and may be fastened with a thin netting, thread, or filament 48, which may melt or disintegrate upon exposure to exhaust gas temperatures to allow the insulation 46 to expand and more completely fill the acoustic chambers between the thermal insulation 28 and the housing 18.

Figure 6:
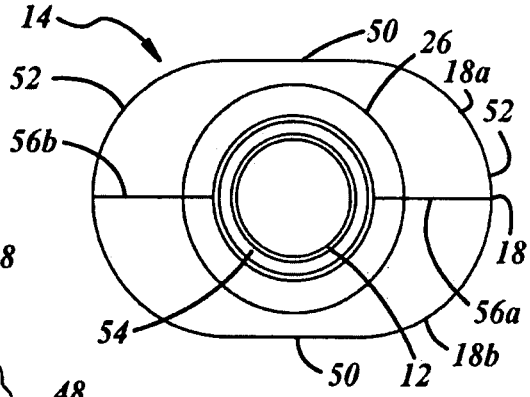
FIG. 6 is an end view of the upstream muffler of FIG. 1.

Referring now to FIG. 6, the trunk 22 of the first muffler 14 may be generally ovular or elliptical in cross-sectional shape and may have flat sides 50 and rounded sides 52. In contrast, the collars 26 may be generally cylindrical for good sealing with the corresponding cylindrical exhaust pipe 12 and its one or more flanges 54. As best shown here, the housing 18 may include a first half 18*a* and a second half 18*b* that assemble to one another and include mating surfaces 56*a*, 56*b* that may define a seam, which may be welded, adhered, or the like.

Figure 7:
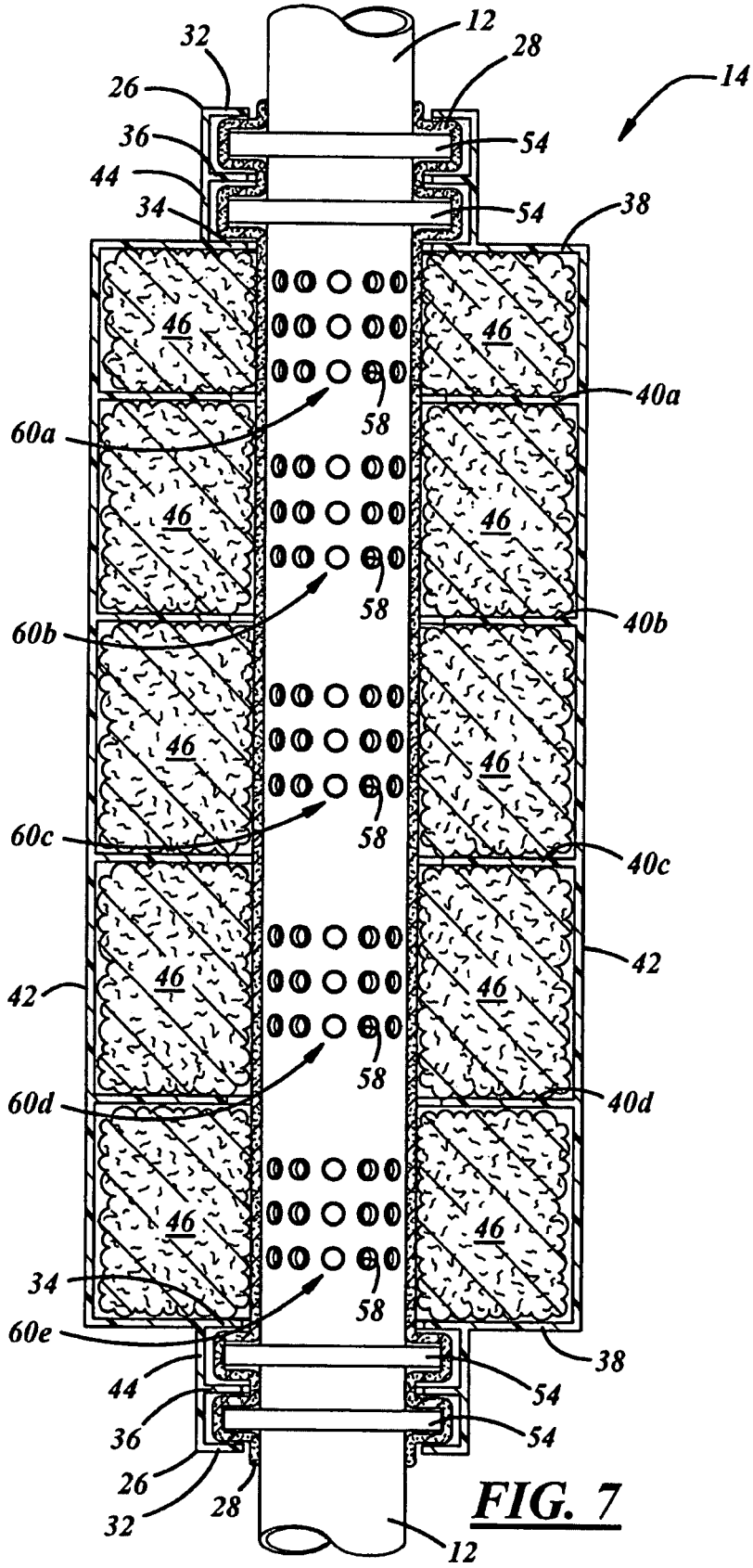
FIG. 7 is a partial cross-sectional view of the upstream muffler of FIG. 1.
Figure 9:
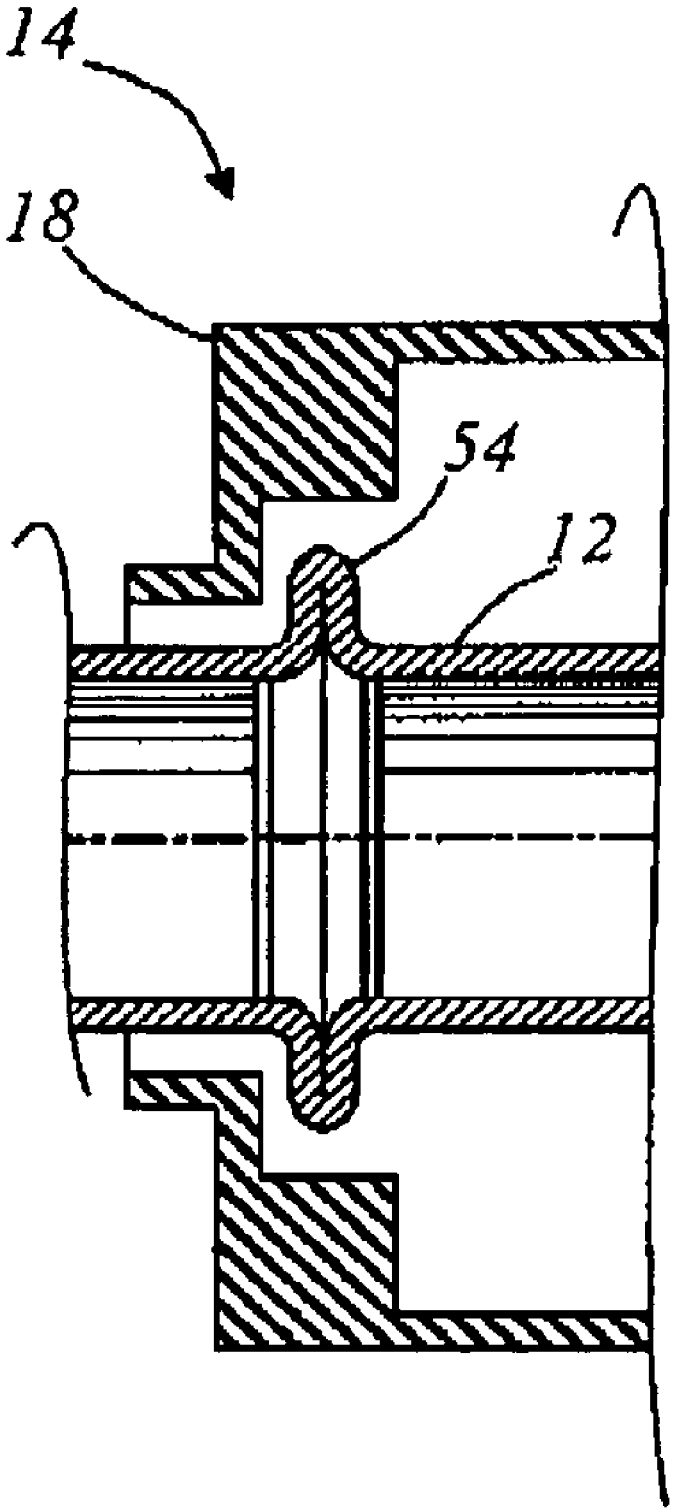
FIG. 9 is a cross-sectional view of another embodiment of the downstream muffler with the thermal insulation removed to show the pipe sealing flange spaced apart from the housing sealing flange and formed from a bead upsetting operation.

Referring now to FIG. 7, the first muffler 14 is shown in partial cross-section with the exhaust pipe 12 shown in solid. At one or both of the axial ends of the muffler 14, the exhaust pipe 12 may include the one or more generally radially extending sealing flanges 54 that are axially spaced apart. Two flanges 54 on each end are shown but any desired quantity and configuration may be used. The sealing flanges 54 may be separate pieces of metal, such as rings, carded by the exhaust pipe 12 such as via welding, brazing, fastening, press fitting, or any other suitable technique. As shown in FIG. 9, the sealing flanges 54 may also, or instead, be integral portions of the exhaust pipe 12 that may be formed by a bead upsetting operation. It is further contemplated that the sealing flanges 54 may also, or instead, be integral portions of the exhaust pipe 12 that may be formed by butt welding of pipe end flanges or any other suitable techniques. The sealing flanges 54 may be disposed in alternating axial arrangement with the housing sealing flanges including the walls 32, 34, 36.

Also, between the ends of the muffler 14, the exhaust pipe 12 may include perforations 58 that may include a plurality of sets 60*a*, 60*b*, 60*c*, 60*d*, 60*e* of the perforations 58 that may be axially spaced apart. The quantity, size, spacing, and/or other parameters of the perforations 58 of any given set 60*a*-60*e* may provided in correspondence to the volume, length, diameter, and/or other parameters of the corresponding acoustic chambers. Those skilled in the art will recognize that such parameters will vary from application to application depending, for example, on exhaust pipe size, exhaust flow rates, exhaust temperatures, and the like.

Nonetheless, the relative sizes, quantities, spacing, and/or other parameters of the perforations, and the corresponding acoustic chamber volumes and/or other parameters of the acoustic chambers, may provide relatively wide frequency band attenuation from chamber to chamber with at least some overlap of frequency attenuation from one chamber to another. The parameters may be selected to achieve in-chamber acoustic attenuation ranges over, for example, a 50 Hz range up to a 600 Hz range. More particularly the parameters may be selected to provide on the order of about a 300 Hz range of acoustic attenuation in any given chamber. Also, the parameters may be selected to provide frequency band overlapping from chamber to chamber to avoid standing peaks of certain frequencies in order to obtain satisfactory acoustic performance. Non-limiting examples of muffler parameter values are provided below.

The first acoustic chamber defined between the end wall 38 and the first divider wall 40*a* may be of a first axial length, such as about 65 mm. The second acoustic chamber defined between the first and second divider walls 40*a*, 40*b* may be of a second length greater than the first, such as about 95 mm. The third and fourth acoustic chambers defined between the second through fourth divider walls 40*b*, 40*c*, 40*d* may be of an equal third length greater than the second, such as about 104 mm. The fifth acoustic chamber defined between the fourth divider wall 40*d* and the end wall 38 may be of a fourth length less than the third but greater than the second, such as about 100 mm.

The acoustic chambers and perforations 58 may be arranged and sized to attenuate overlapping acoustic frequency bands. For example, the first acoustic chamber and set of perforations 60*a* may attenuate about 450 to about 700 Hz with a target of about 600 Hz. The second acoustic chamber and set of perforations 60*b* may attenuate about 400 to about 500 Hz with a target of about 450 Hz. The third and fourth acoustic chambers and sets of perforations 60*c*, 60*d* may attenuate about 150 to about 350 Hz and target about 250 Hz. Finally, the fifth acoustic chamber and set of perforations 60*e* may attenuate about 300 to about 400 Hz with a target of about 350 Hz. The acoustic insulation 46 further assists to attenuate a broader, higher frequency band, for example, from about 600 Hz to about 3,000 Hz.

Still referring to FIG. 7, the thermal insulation 28 may extend from a location downstream of a downstream set of the pipe sealing flanges 54, over the exhaust pipe 12, and to a location upstream of an upstream set of the flanges 54. The thermal insulation 28 may hug the pipe 12 and flanges 54 and may cover the perforations 58. The thermal insulation 28 may be permeable to allow gas to pass therethrough. The thermal insulation 28 may be one layer as shown, but may include multiple layers such as from multiple sleeves or a sleeve folded or rolled back onto itself. The thermal insulation 28 may be disposed between the acoustic insulation 46 and the exhaust pipe 12, such that the acoustic insulation 46 may be separate from the thermal insulation 28. In other words, the acoustic insulation 46 may be independent of the thermal insulation 28 although the two may contact one another.

The housing 18 may be radially spaced from the exhaust pipe 12. As shown in FIGS. 4, 5, and 7, the radially extending end walls 32, 34, 38 and divider walls 36, 40*a*-40*d* of the housing 18 have radially inner surfaces or diameters. As best shown in FIG. 7, the internal size of the radially inner surfaces or diameters is greater than the external size of the outer surface or diameter of the exhaust pipe 12, thereby defining radial spaces therebetween. Also, the axially extending shell walls 42, 44 of the housing 18 are also greater in size than corresponding portions of the exhaust pipe 12 to define radial spaces therebetween.

Figure 8:
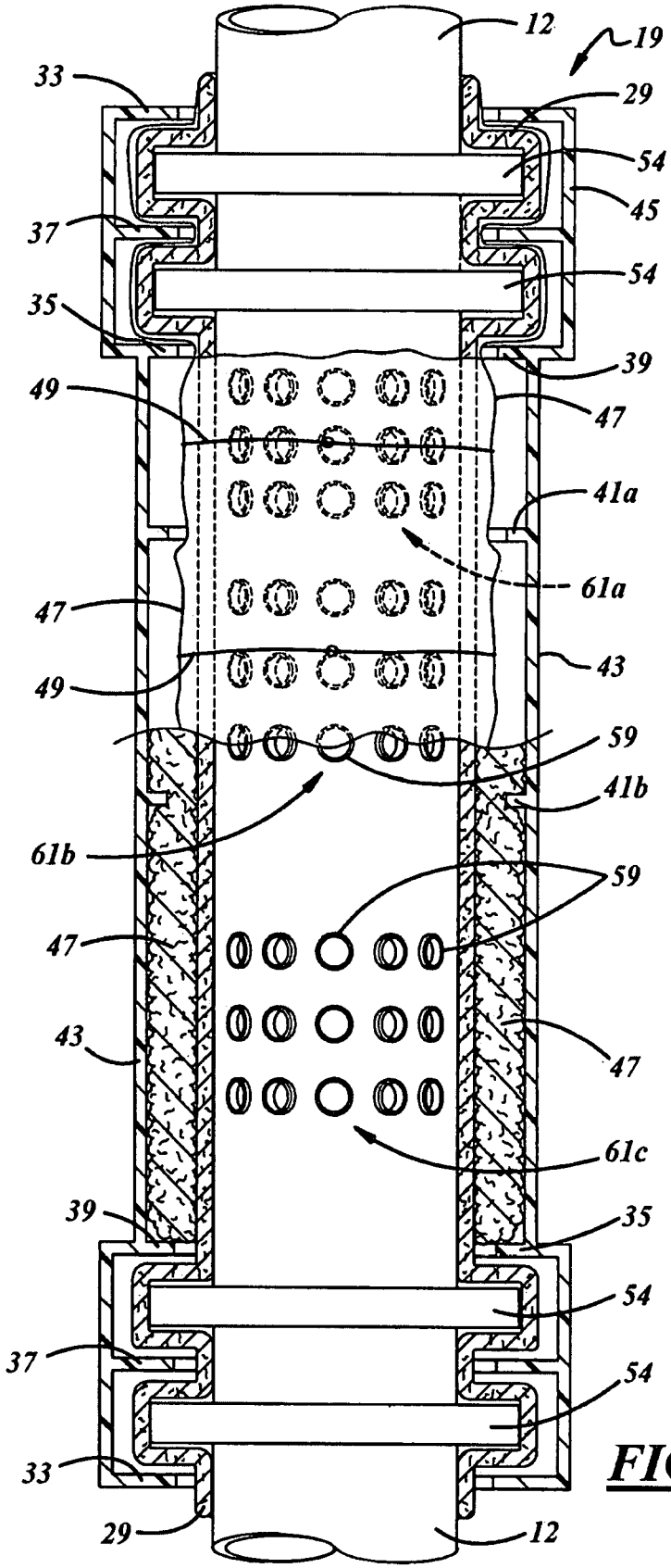
FIG. 8 is a partial cross-sectional view of the downstream muffler of FIG. 1.

Referring finally to FIG. 8, the second muffler 15 is shown in a partial cross-sectional view that is split. The second muffler 15 is substantially similar to the first muffler 14 except for some shaping and sizing. On one side of the split, acoustic insulation 47 is shown in an expanded state. On another side of the split, the acoustic insulation 47 is shown restrained with a thin netting, thread, or filament 49. In this example, thermal insulation 29 may be assembled to the exhaust pipe 12, and then the acoustic insulation 47 may be assembled over the thermal insulation 29 instead of or in addition to being packed into the housing 19. The acoustic insulation 47 may extend into the sealing ends between the collars 27 and the exhaust pipe 12, as shown. In any case, the netting or filament 49 may disintegrate or melt away upon exposure to the heat of exhaust gases so that the insulation 47 may expand and fill corresponding muffler chambers. Unlike the multiple individual pieces of acoustic insulation 46 of the first muffler 14, the acoustic insulation 47 may be a single piece for assembly to the exhaust pipe 12. As discussed above with respect to the first muffler 14, at one or both of the ends of the second muffler 15 the exhaust pipe 12 may include one or more flanges 54 axially spaced apart.

The second muffler housing 19 may include the trunk 23, and the collars 27 at axially opposed ends of the housing 19. The collars 27 may include one or more generally radially extending sealing flanges, for example, axially outer end walls 33, axially inner end walls 35, and one or more divider walls 37 therebetween. The sealing flanges 54 may be disposed in alternating axial arrangement with the housing sealing flanges including the walls 33, 35, 37.

Similarly, the trunk 23 may include axially outer end walls 39, and one or more divider walls 41*a*, 41*b* therebetween. The divider walls 41*a*, 41*b* and end walls 39 define a plurality of acoustic chambers. As with the first muffler 14, the walls 39, 41*a*, 41*b* may be evenly spaced apart and/or may be unevenly spaced in any suitable manner to provide equal or unequal sized acoustic chambers. Any suitable quantities and configurations of flanges or walls may be used.

Also, between the ends of the muffler 15, the exhaust pipe 12 may include perforations 59 that may include a plurality of sets 61 of the perforations 59 that may be axially spaced apart. As previously disclosed in the example above with respect to the first muffler 14, the quantity, size, spacing, and other parameters of the perforations 59 may provided in correspondence to the volume, length, diameter, and other parameters of the acoustic chambers.

The thermal insulation 29 may extend over and between the flanges 54 and along the pipe 12 to hug the pipe 12 and flanges 54 and cover the perforations 59. The thermal insulation 29 may be one layer as shown, but may include multiple layers such as from multiple sleeves or from a sleeve folded or rolled back onto itself. The thermal insulation 29 may be disposed between the acoustic insulation 47 and the exhaust pipe 12.

The housing 15 may be radially spaced from the exhaust pipe 12. The radially extending end walls 33, 35, 39 and divider walls 37, 41*a*-41*b* of the housing 19 have radially inner surfaces or diameters. The internal size of the radially inner surfaces or diameters is greater than the external size of the outer surface or diameter of the exhaust pipe 12, thereby defining radial spaces therebetween. Also, the axially extending shell walls 43, 45 of the housing 19 are also greater in size than corresponding portions of the exhaust pipe 12 to define radial spaces therebetween.

One or both of the mufflers 14, 15 may provide one or more of the following benefits to one degree or another. It is estimated that the mufflers 14, 15 may weigh on the order of about 25% less than current mufflers, may cost on the order of about 20% less than current mufflers (not including downstream vehicle assembly savings), and may be on the order of about 50% smaller than current mufflers, which may lead to better packaging of exhaust systems within vehicles. Also, because of good thermal insulation performance, it is believed that the mufflers 14, 15 may reduce or eliminate the current need to provide heat shields between current mufflers and other portions of the vehicle. Because the mufflers 14, 15 are flow-through or absorption mufflers, they may yield less backpressure in the exhaust system 10, thereby possibly leading to better engine performance, fuel economy, and the like.

Moreover, the mufflers 14, 15 may provide better, or at least comparable, acoustic attenuating performance with respect to current reflection mufflers. Accordingly, the mufflers 14, 15 may provide a particularly significant advantage when used for non-automotive applications conventionally requiring absorption muffler designs.

While certain preferred embodiments have been shown and described, persons of ordinary skill in this art will readily recognize that the preceding description has been set forth in terms of description rather than limitation, and that various modifications and substitutions can be made without departing from the spirit and scope of the invention. The invention is defined by the following claims.

What is claimed is:

1. A muffler comprising:

an exhaust pipe having a plurality of perforations and at least one pipe sealing flange extending generally radially outwardly;

a polymeric housing carried by the exhaust pipe and enclosing the plurality of perforations, the polymeric housing including (a) at least one polymeric housing sealing flange integrally formed of the polymeric housing extending generally radially inwardly toward the exhaust pipe and spaced radially from the exhaust pipe and spaced axially from the at least one pipe sealing flange and (b) at least one polymeric divider wall integrally formed of the polymeric housing disposed within the polymeric housing that at least partially defines a plurality of acoustic chambers within the polymeric housing that each is disposed in fluid flow communication with a corresponding plurality of exhaust pipe perforations; and thermal insulation disposed axially between the at least one pipe sealing flange and the at least one housing sealing flange, radially between the at least one housing sealing flange and the exhaust pipe, and radially between the at least one pipe sealing flange and the housing.

2. The muffler of claim 1, further comprising:

acoustic insulation disposed between the exhaust pipe and the housing including in each one of the plurality of acoustic chambers.

3. The muffler of claim 2, wherein the acoustic insulation is composed of a glass fiber batting and the thermal insulation is composed of a glass fiber sleeve.

4. The muffler of claim 1, wherein the housing includes a plurality of housing sealing flanges with the at least one pipe sealing flange therebetween.

5. The muffler of claim 4, wherein the at least one pipe sealing flange includes a plurality of annular pipe sealing flanges in alternating axial arrangement with the plurality of annular housing sealing flanges.

6. The muffler of claim 1, further comprising a trunk and axially opposed sealing ends including reduced diameter collars of the housing.

7. The muffler of claim 1, wherein the exhaust pipe is composed of metal, and the thermal insulation is composed of a glass fiber.

8. The muffler of claim 1, further comprising at least one clamping device circumscribing a portion of the housing.

9. The muffler of claim 1, wherein the plurality of perforations formed in the exhaust pipe includes a plurality of sets of perforations corresponding to the acoustic chambers with each one of the plurality of sets of perforations communicating with a corresponding one of the acoustic chambers.

10. The muffler of claim 1 wherein the at least one pipe sealing flange comprises an integral portion of the exhaust pipe formed by a bead upsetting operation.

11. An absorption muffler comprising:

a metallic exhaust pipe including a plurality of perforations;

a polymeric housing carried by the exhaust pipe and enclosing the plurality of perforations, the housing comprised of a tubular sidewall encircling the exhaust pipe and including axially opposed ends and at least one divider wall extending inwardly toward the exhaust pipe at least partially defining a plurality of exhaust gas sound attenuating acoustic chambers within the housing;

thermal insulation disposed between the exhaust pipe and each one of the axially opposed ends of the polymeric housing;

acoustic insulation disposed within the polymeric housing and received in at least one of the acoustic chambers; and wherein one of the plurality of acoustic chambers attenuates one frequency band and another one of the plurality of acoustic chambers attenuates another frequency band.

12. The absorption muffler of claim 11, wherein the housing includes at least one housing sealing flange and the exhaust pipe includes at least one pipe sealing flange adjacent and spaced from the at least one housing sealing flange.

13. The absorption muffler of claim 12 wherein the at least one pipe sealing flange is an integral portion of the exhaust pipe formed by a bead upsetting operation.

14. The absorption muffler of claim 11, wherein the housing is comprised of a plurality of the divider walls that extend radially inwardly from the housing sidewall, that are radially spaced from the exhaust pipe providing a space therebetween, and that at least partially define a plurality of the acoustic chambers therebetween.

15. The absorption muffler of claim 11, wherein the plurality of acoustic chambers and the plurality of perforations in the metallic exhaust pipe attenuate overlapping frequency bands and wherein the acoustic insulation provides another band of frequency attenuation in frequency range than the band of frequency attenuation provided by the at least one acoustic chamber in which the acoustic insulation is received.

16. The absorption muffler of claim 11 wherein the polymeric housing, including the tubular sidewall, axially opposed ends, and at least one divider wall is formed as a unit of one-piece, unitary, and substantially homogeneous polymeric construction.

17. The absorption muffler of claim 16 wherein the polymeric housing is formed of a plurality of clamshell halves that each have at least one generally axially or longitudinally extending mating surface.

18. The absorption muffler of claim 11 wherein the one of the plurality of acoustic chambers is configured with a size that is different than the another one of the plurality of acoustic chambers.

19. The absorption muffler of claim 18 wherein there is at least plurality of unequally spaced apart divider walls defining the differently sized acoustic chambers.

20. A polymeric housing for a muffler carried by an exhaust pipe having a plurality of perforations formed in a portion of the exhaust pipe, comprising:

an outer shell comprised of a plurality of clamshell halves that engage one another along mating surfaces encompassing the plurality of perforations formed in the exhaust Pipe;

a plurality of divider walls extending generally radially inwardly from each one of the clamshell halves toward an outer surface of the exhaust pipe;

a pair of spaced apart ends; and wherein the plurality of ends and divider walls are axially spaced from one another at least partially defining a plurality of chambers therebetween in which acoustic insulation is received with each one of the plurality of chambers communicating with a corresponding plurality of the perforations formed in the exhaust pipe and providing frequency band attenuation that is overlapping from one of the plurality of chambers to another one of the plurality of chambers.

21. The polymeric housing of claim 20, and being composed of a polyimide material.

22. The polymeric housing of claim 20 wherein the ends each comprise an end wall and wherein the end walls and divider walls are unequally spaced from one another to at least partially define a plurality of differently sized chambers.

23. The polymeric housing of claim 20 wherein each end comprises a sealing end configured to cooperate with at least one sealing flange of the exhaust pipe comprises a bead-upset formed flange integrally formed of a portion of the exhaust pipe.

24. A polymeric housing for a muffler carried by an exhaust pipe having a plurality of perforations formed in a portion of the exhaust pipe, comprising:

an outer tubular polymeric shell encompassing a portion of the exhaust pipe having the plurality of perforations, with the outer tubular polymeric shell having a pair of ends and at least one divider wall extending toward the exhaust pipe defining a plurality of acoustic chambers in which acoustic insulation is disposed;

wherein one of the plurality acoustic chambers communicates with a first plurality of the perforations in the exhaust pipe and provides attenuation of a first frequency band and another one of the plurality of acoustic chambers communicates with a second plurality of perforations in the exhaust pipe and provides attenuation of a second frequency band;

wherein the acoustic insulation attenuates a third frequency band; and wherein the outer tubular polymeric shell, including the pair of ends and at least one divider wall, is of one-piece, unitary, and substantially homogeneous polymeric construction.

25. The absorption muffler of claim 24 wherein the polymeric shell is formed of a plurality of clamshell halves that each have at least one mating surface with each clamshell half being of one-piece, unitary and substantially homogeneous construction.

26. The absorption muffler of claim 24 wherein each one of the plurality of acoustic chambers is configured to have a different size.

27. The absorption muffler of claim 26 wherein there is at least plurality of unequally spaced apart divider walls defining the differently sized acoustic chambers.

28. The absorption muffler of claim 24 wherein the plurality of acoustic chambers are configured so the first frequency band attenuated by the one of the plurality of acoustic chambers overlaps a portion of the second frequency band attenuated by the another one of the plurality of acoustic chambers and wherein the third frequency band attenuated by the acoustic insulation encompasses a frequency range that is broader than the first and second frequency bands and extends to a frequency higher than the highest frequency of the first and second frequency bands.

* * * * *